US008695546B2

(12) United States Patent
Choi

(10) Patent No.: US 8,695,546 B2
(45) Date of Patent: Apr. 15, 2014

(54) ENGINE EQUIPPED WITH VARIABLE VALVE DEVICE

(75) Inventor: Myungsik Choi, Seoul (KR)

(73) Assignees: Hyundai Motor Company, Seoul (KR); Kai Motors Corporation, Seoul (KR)

( * ) Notice: Subject to any disclaimer, the term of this patent is extended or adjusted under 35 U.S.C. 154(b) by 546 days.

(21) Appl. No.: 12/957,174

(22) Filed: Nov. 30, 2010

(65) Prior Publication Data

US 2012/0067313 A1 Mar. 22, 2012

(30) Foreign Application Priority Data

Sep. 20, 2010 (KR) ..... 10-2010-0092696

(51) Int. Cl.
*F01L 1/34* (2006.01)

(52) U.S. Cl.
USPC ..... 123/90.16

(58) Field of Classification Search
USPC ..... 123/90.16, 90.12, 90.45, 90.52, 90.55, 123/90.39, 90.46
See application file for complete search history.

(56) References Cited

U.S. PATENT DOCUMENTS

| | | | | |
|---|---|---|---|---|
| 5,503,120 | A * | 4/1996 | Shirey et al. | 123/90.12 |
| 5,829,397 | A * | 11/1998 | Vorih et al. | 123/90.12 |
| 6,192,841 | B1 * | 2/2001 | Vorih et al. | 123/90.12 |
| 7,156,062 | B2 * | 1/2007 | Vanderpoel | 123/90.59 |

FOREIGN PATENT DOCUMENTS

| | | |
|---|---|---|
| JP | 11236809 A | 8/1999 |
| KR | 1020080023552 A | 3/2008 |

* cited by examiner

*Primary Examiner* — Kenneth Bomberg
*Assistant Examiner* — Jason T Newton
(74) *Attorney, Agent, or Firm* — Morgan, Lewis & Bockius LLP

(57) ABSTRACT

An engine that may be provided with a variable valve device may include an hydraulic pressure lash adjuster pivotally supporting one side of a swing arm, a valve supporting the other side of the swing arm, and an operating portion pushing a portion of the swing arm downwards so as to pivotally move the valve based on the hydraulic pressure lash adjuster, wherein the hydraulic pressure lash adjuster includes a housing in which an insertion hole may be formed therein, a slave piston that may be slidably inserted into the insertion hole, a master piston of which an end thereof may be placed into the insertion hole with a predetermined gap from the slave piston, wherein the other end of the master piston protrudes out of the housing and may be engaged with the one side of the swing arm, and an oil control valve that opens or closes a passage communicating with a master chamber that may be formed between the master piston and the slave piston in the housing.

9 Claims, 5 Drawing Sheets

ENGINE EQUIPPED WITH VARIABLE VALVE DEVICE

CROSS-REFERENCE TO RELATED APPLICATION

The present application claims priority to Korean Patent Application No. 10-2010-0092696 filed in the Korean Intellectual Property Office on Sep. 20, 2010, the entire contents of which is incorporated herein for all purposes by this reference.

BACKGROUND OF THE INVENTION

1. Field of the Invention

The present invention relates to an engine provided with a variable valve device that variably controls a motion of a valve disposed at an intake port or an exhaust port of a combustion chamber so as to improve fuel efficiency.

2. Description of Related Art

Some means for varying the timing of valve actuation of internal combustion engines are very well known. Such means typically take the form of a camshaft, a rocker arm, or a finger follower so as to control the valve motion.

A variable valve device is especially well known in spark ignited engines, in which it is an essential element of various schemes for improving fuel economy, and there is a method using a profile of a cam to control valve lift and using a lost motion so as to control valve lift.

Meanwhile, a pivot portion is used so as to reduce a gap between a valve and a swing arm in a variable valve train, but it is difficult to simply or compactly constitute the variable valve train and the hydraulic pressure lash adjuster in a restricted space.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an engine that is provided with a variable valve device having advantages of constituting a hydraulic pressure lash adjuster and a valve deactivation device in a simple structure.

In an aspect of the present invention, the engine that may be provided with a variable valve device, may include an hydraulic pressure lash adjuster pivotally supporting one side of a swing arm, a valve supporting the other side of the swing arm, and an operating portion pushing a portion of the swing arm downwards so as to pivotally move the valve based on the hydraulic pressure lash adjuster, wherein the hydraulic pressure lash adjuster may include a housing in which an insertion hole may be formed therein, a slave piston that may be slidably inserted into the insertion hole, a master piston of which an end thereof may be placed into the insertion hole with a predetermined gap from the slave piston, wherein the other end of the master piston protrudes out of the housing and may be engaged with the one side of the swing arm, and an oil control valve that opens or closes a passage communicating with a master chamber that may be formed between the master piston and the slave piston in the housing.

The engine may further include a stopper that may be disposed inside the insertion hole such that the slave piston cannot move towards the master piston, a master spring that elastically supports the master piston outwards in the master chamber, and a slave spring that elastically supports the slave piston towards the stopper in the insertion hole.

A slave chamber may be formed between an end surface of the slave piston and an inside end surface of the insertion hole of the housing, and a drain hole through which oil in the slave chamber may be exhausted may be formed thereto.

A brake chamber may be formed by a slave step of which an exterior diameter of the slave piston becomes narrower, an housing inside surface of the housing, a housing step of which an interior diameter of the housing becomes narrower, and a slave outside surface of the slave piston at an opposite side of the master piston, wherein the slave outside surface of the slave piston and the inside end surface of the insertion hole may be slidably in contact and the housing inside surface and external circumference of the slave piston may be slidably in contact.

A brake chamber may be formed by a slave step of which an exterior diameter of the slave piston becomes narrower, a housing inside surface, a housing step of which an interior diameter of the housing becomes narrower, and a slave outside surface of the slave piston at an opposite side of the master piston, wherein an orifice may be formed in the slave piston so as to connect the brake chamber with the slave chamber, wherein the slave outside surface of the slave piston and the inside end surface of the insertion hole may be slidably in contact and the housing inside surface and external circumference of the slave piston may be slidably in contact.

The engine may further a brake chamber oil supply line that may be connected to the brake chamber for supplying the brake chamber with oil.

The engine may further include a latching pin slidably disposed in a latching chamber formed in the master piston to selectively fix the master piston to the housing such that the master piston cannot move in the housing, and a hydraulic pressure supply portion that supplies one side of the latching pin with hydraulic pressure in the latching chamber so as to move the latching pin, wherein an end of the latching pin may be slidably inserted into a side of the master piston and the other end thereof may be selectively inserted into a side of the housing such that the master piston may be selectively fixed in the housing.

The engine may further include a return spring that elastically pushes the latching pin such that the latching pin may be biased to the housing, wherein latching pins may be respectively disposed at both sides based on a center portion of the master piston in the latching chamber, each end portion thereof may be selectively inserted through the master piston into the housing, and the hydraulic pressure supply portion supplies the latching pins with hydraulic pressure through the housing and the master piston.

A latching chamber may be formed at an interior circumference of the housing and the latching pin may be slidably inserted into the latching chamber, a latching groove may be formed at an exterior circumference of the master piston corresponding to the latching chamber to selectively receive the latching pin therein, and the hydraulic pressure supply portion selectively supplies hydraulic pressure to the latching chamber to latch the latching pin with the latching groove such that the housing and the master piston may be fixed or slides from each other, wherein a latching spring may be disposed in the latching chamber to elastically supports the latching pin.

As stated above, a variable valve device is provided in a hydraulic pressure lash adjuster such that the overall structure becomes small and the weight can reduced in an engine that is provided with a variable valve device according to the present invention.

Further, motion of the swing arm can be accurately controlled by the slave piston so as to variably control the valve actuation.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
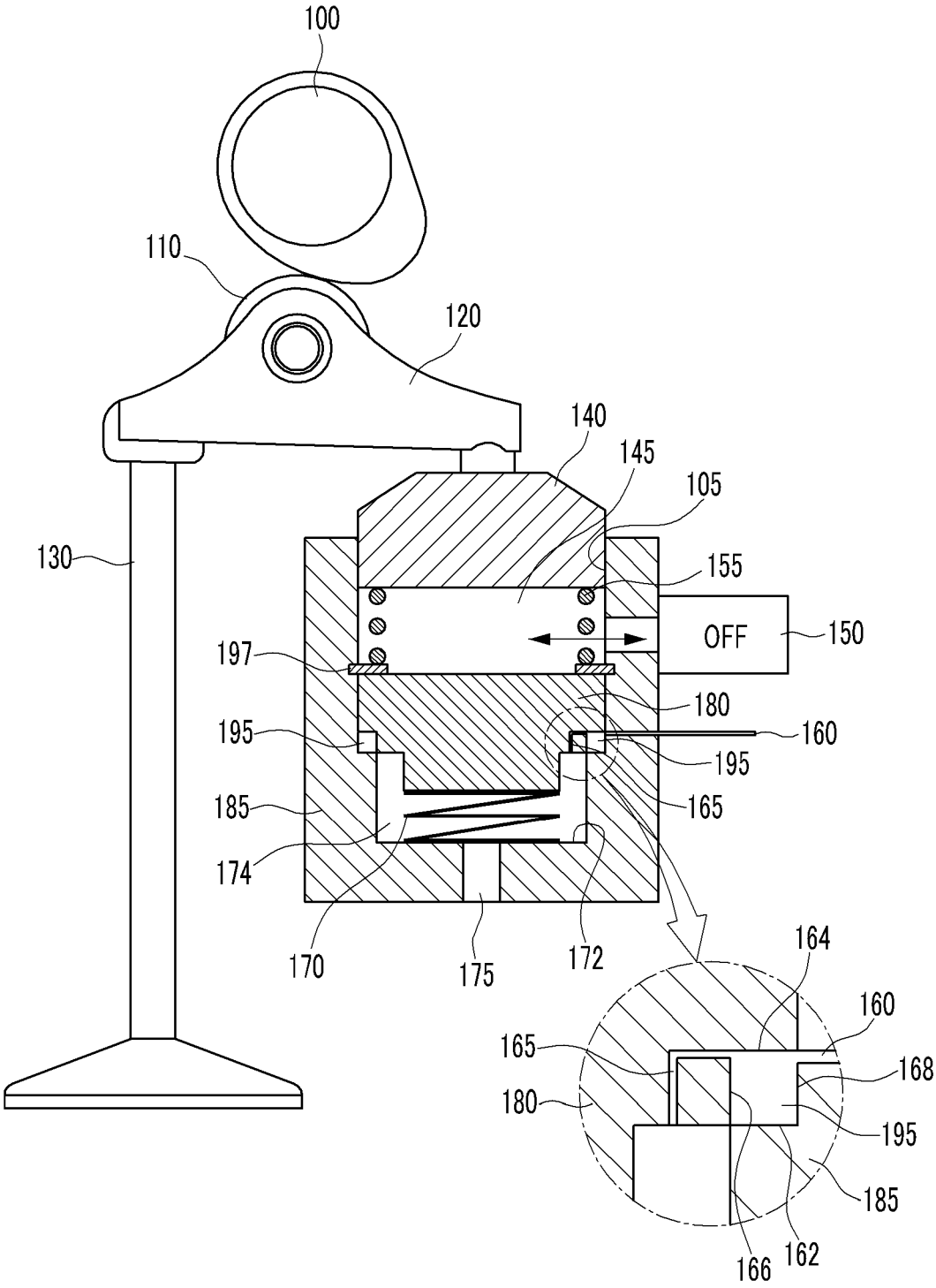
FIG. 1 is a cross-sectional side view of an engine that is provided with a variable valve device according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a cross-sectional side view of an engine that is provided with a variable valve device according to an exemplary embodiment of the present invention.

Referring to FIG. 1, a camshaft 100 is disposed at the top thereof, a swing arm 120 is disposed at the lower side of the camshaft 100, a valve 130 is disposed at the lower left side of the swing arm 120, and a hydraulic pressure lash adjuster is disposed at a right side of the swing arm 120. The hydraulic pressure lash adjuster includes a housing 185 that covers the outside, and a master piston 140 that protrudes at the upper side of the housing 140.

The valve 130 supports the left lower portion of the swing arm 120, and the hydraulic pressure lash adjuster supports the right lower portion of the swing arm 120.

A roller 110 is disposed at the middle upper side of the swing arm 120, and the roller 100 contacts a cam lobe of the camshaft 100. The valve 130 is elastically supported by a valve spring that is not shown in FIG. 1.

If the camshaft 100, as an operating portion, rotates, the cam lobe of the camshaft 100 pushes the roller 110 downwards such that the valve 130 is moved downwards.

Hereinafter, a structure of the hydraulic pressure lash adjuster will be described with reference to the figures.

The hydraulic pressure lash adjuster includes the housing 185, the master piston 140, a master spring 155, a stopper 197, a slave piston 180, a slave spring 170, and a oil control valve 150.

An insertion hole 105 is formed in the housing, the insertion hole is opened to the upper side, and the slave spring 170, the slave piston 180, the stopper 197, the master spring 155, and the master piston 140 are sequentially inserted into the insertion hole.

The slave spring 170 elastically supports the slave piston 180 upwards, and the stopper 197 restricts the motion of the slave piston such that the slave piston 180 is not drawn out. Accordingly, the edge upper surface of the slave spring 170 contacts the lower surface of the stopper 197.

A lower end of the master spring 155 is supported by the stopper 197, and an upper end thereof elastically supports the master spring 155 upwards. Accordingly, the upper end of the master piston 140 contacts the lower surface of the swing arm 120.

The exterior circumference of the master piston 140 contacts the interior of the housing 185 around the circumference thereof, and a master chamber 145 that is formed between the master piston 140 and the slave piston 180 is a sealed space.

Further, the exterior circumference of the slave piston 180 contacts the interior of the housing 185 around the circumference thereof, and the slave chamber 174 is formed between the slave piston 180 and the inside end surface of the housing 185.

The oil control valve 150 selectively opens a passage communicating with the master chamber 145 to induce a lost motion of the master piston 140.

Figure 2:
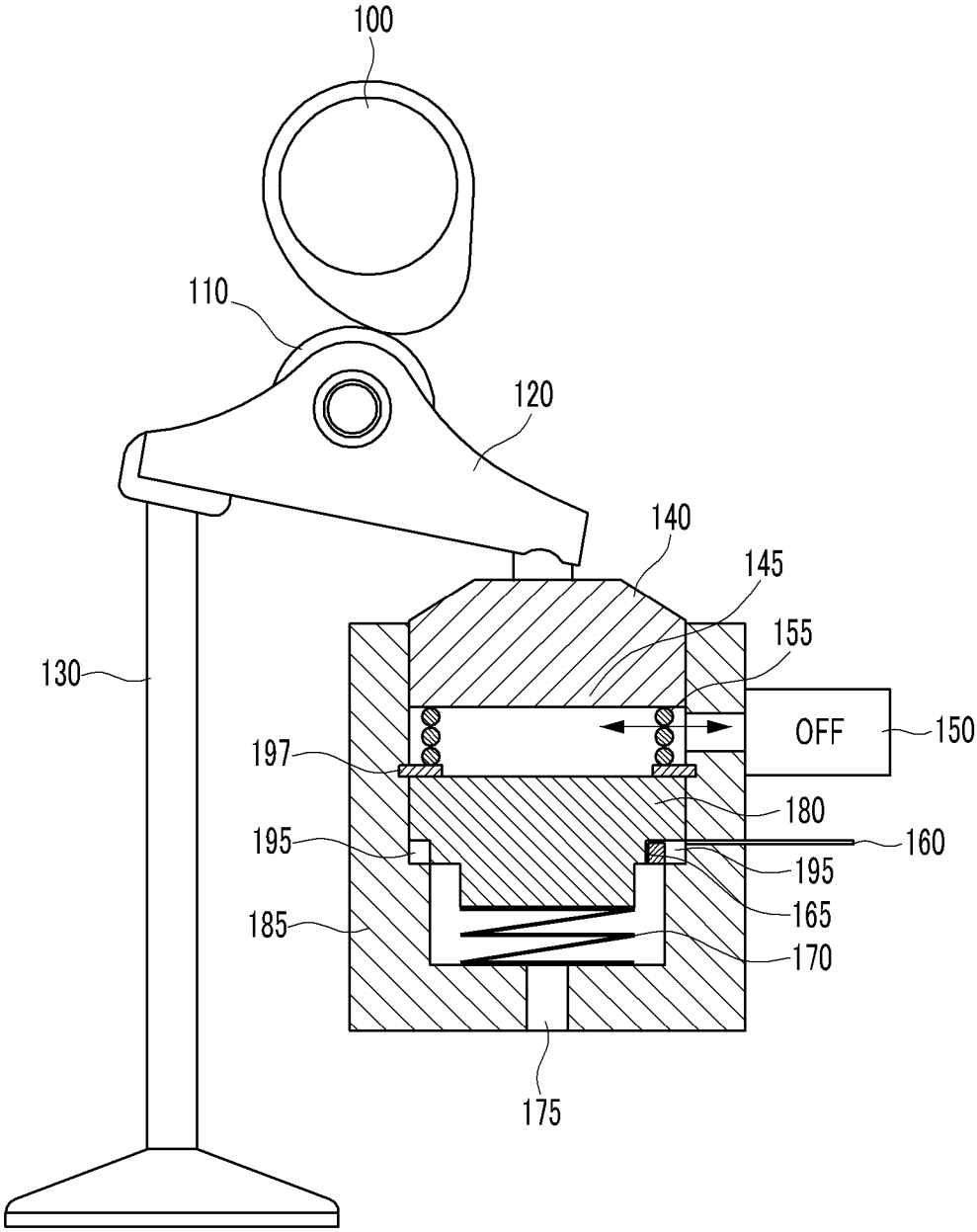
FIG. 2 is a cross-sectional side view showing a swing arm performing a lost motion in an engine that is provided with a variable valve device according to an exemplary embodiment of the present invention.

FIG. 2 is a cross-sectional side view showing a swing arm performing a lost motion in an engine that is provided with a variable valve device according to an exemplary embodiment of the present invention.

Referring to FIG. 2, while the oil control valve 150 is opened, if the camshaft 100 rotates, the roller 110 of the swing arm 120 moves downwards, and the swing arm 120 pushes the valve 130 and the master piston 140 downwards.

In this case, the master piston 140 is inserted into the inside of the housing 185, and the valve 130 is supported by a valve spring to not move. Further, the master spring 155, which is disposed between the master piston 140 and the stopper 197, is compressed.

Further, because the oil control valve 150 is opened, the hydraulic pressure formed in the master chamber 145 is exhausted through the oil control valve 150, and the slave piston 180 does not move.

Figure 3:
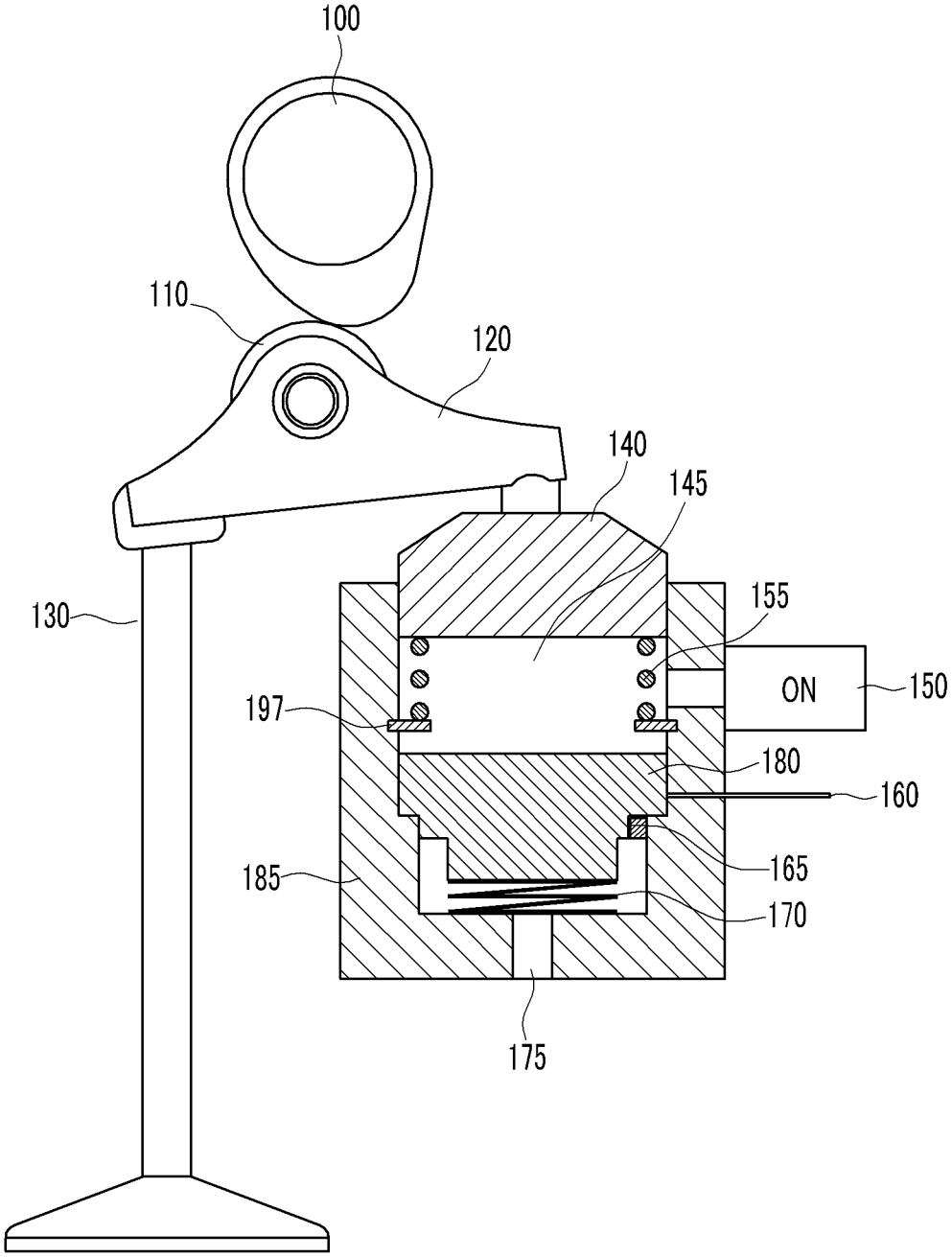
FIG. 3 is a cross-sectional side view showing a swing arm moving a valve in an engine that is provided with a variable valve device according to an exemplary embodiment of the present invention.

FIG. 3 is a cross-sectional side view showing a swing arm moving a valve in an engine that is provided with a variable valve device according to an exemplary embodiment of the present invention.

Referring to FIG. 3, while the oil control valve 150 is closed, if the camshaft 100 rotates, the right side of the swing arm 120 is fixedly supported by the master piston 140, and the valve 130 together with the left side of the swing arm 120 is forced downwards.

In an exemplary embodiment of the present invention, while the oil control valve 150 is closed, if the camshaft 100 pushes the swing arm 120 and the roller 110 downwards, a force thereof is simultaneously applied to the master piston 140 and the valve 130.

Instantly, the inside pressure of the master chamber 145 is raised by the force applied to the master piston 140, and the slave piston 180 moves downwards a small amount. Further, the master piston 140 moves downwards a small amount in accordance with the movement of the slave piston 180.

Accordingly, the early movement of the valve 130 is damped to be slowly moved.

An assembly structure of the slave piston 180 and the housing 185 will be described with reference to the FIG. 1.

At the side of the expanded part of FIG. 1, a slave step 164 is formed at a lower portion of the slave piston 180 such that the diameter thereof is reduced, and a housing step 162 is formed inside the housing 185 corresponding to the slave step 164 with a predetermined distance from the slave step 164.

Further, a slave outside surface 166 is formed at an exterior circumference of the slave piston 180 with a predetermined distance from a housing inside surface 168 of the housing 185.

The slave step 164, the slave outside surface 166, the housing step 162, and the housing inside surface 168 form a brake chamber 195. The brake chamber 195 is connected to a brake chamber oil supply passage 160 to receive hydraulic pressure from an oil line. Further, the brake chamber 195 is formed along the circumference of the lower end of the slave piston 180.

In addition, a slave chamber 174 is formed between the lower end of the slave piston 180 and the inside end surface 172 of the housing 185, and the slave chamber 174 communicates with a drain hole 175.

As shown, an orifice 165 connects the brake chamber 195 with the slave chamber 174. In this case, it is desirable that the diameters of the orifice 165 and the brake chamber oil supply passage range 160 from 0.1 to 5 mm.

Referring to FIG. 3, if the oil control valve 150 is closed and the pressure of the master chamber 145 is increased, a downward force is applied to the slave piston 180, and the pressure of the brake chamber 195 is increased.

Further, the oil in the brake chamber 195 moves to the slave chamber 174 through the orifice 165, and the oil of the slave chamber 174 is drained through the drain hole 175.

Further, the downward movement of the slave piston 180 is restricted by the housing step 162. Accordingly, the valve 130 is slowly depressed during the downward movement of the slave piston 180, and the valve is quickly depressed after the slave piston 180 is fixed downwards.

Further, while the camshaft 100 rotates, if the cam does not push the swing arm 120 downwards, the slave piston 180 is returned upwards by the slave spring 170 to be supported by the stopper 197.

Figure 4:
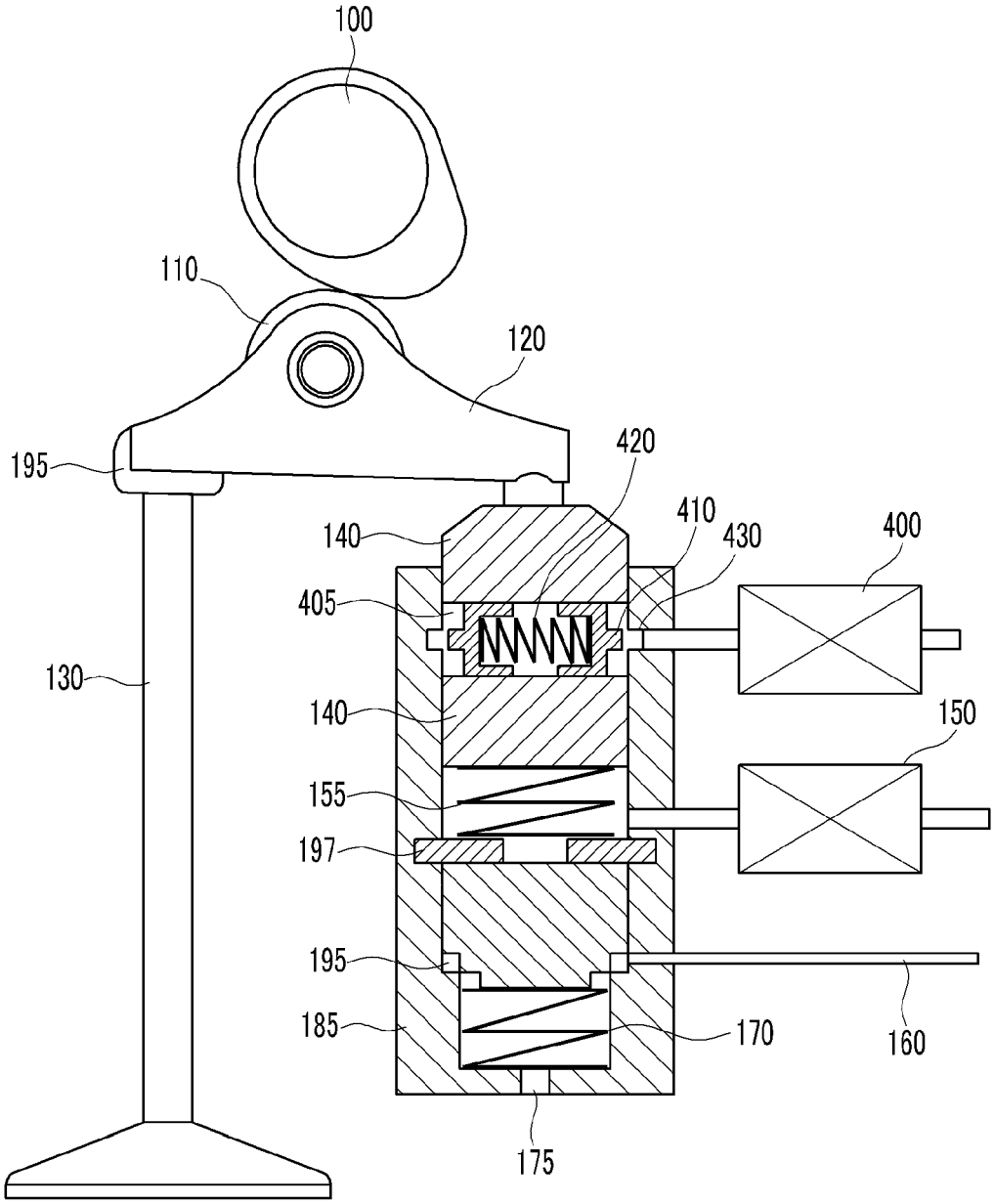
FIG. 4 is a cross-sectional side view of an engine that is provided with a variable valve device according to other exemplary embodiment of the present invention.

FIG. 4 is a cross-sectional side view of an engine that is provided with a variable valve device according to other exemplary embodiment of the present invention.

As compared with the features of FIGS. 1, 2, and 3, distinct parts will be described referring to FIG. 4, and a detailed description regarding similar parts will be omitted.

Referring to FIG. 4, a latching chamber 405 is formed in the master piston 140, which is opened to both sides, and a latching pin 410 is inserted into the latching chamber 405 to be disposed at both sides thereof.

A latching spring 420 is interposed between the latching pins 410, and the latching spring 420 elastically pulls the latching pin 410 in the central direction.

The latching chamber 405 is connected to an outside oil supply line through the master piston 140 and the housing 185, and a latching oil control valve 400 is disposed in the oil supply line.

If the latching oil control valve 400 is opened, hydraulic pressure is supplied to the inside of the latching chamber 405, and the latching pins 410 respectively move to both sides. Accordingly, the latching pin 410 is engaged with a latching groove 430 that is formed on the interior circumference of the housing 185.

If the end portion of the latching pin 410 is engaged with the latching groove 430, the master piston 140 is fixed to the housing 185. Accordingly, the valve 130 is depressed a large amount.

If oil is not supplied to the master chamber 145 due to low supply pressure or high viscosity at a lower temperature, the oil pressure can be insufficient in the master chamber 145.

In this case, it is desirable that a hydraulic pressure is supplied to the latching chamber 405 such that the master piston 140 is fixed to the housing 185 by the latching pin 410.

Figure 5:
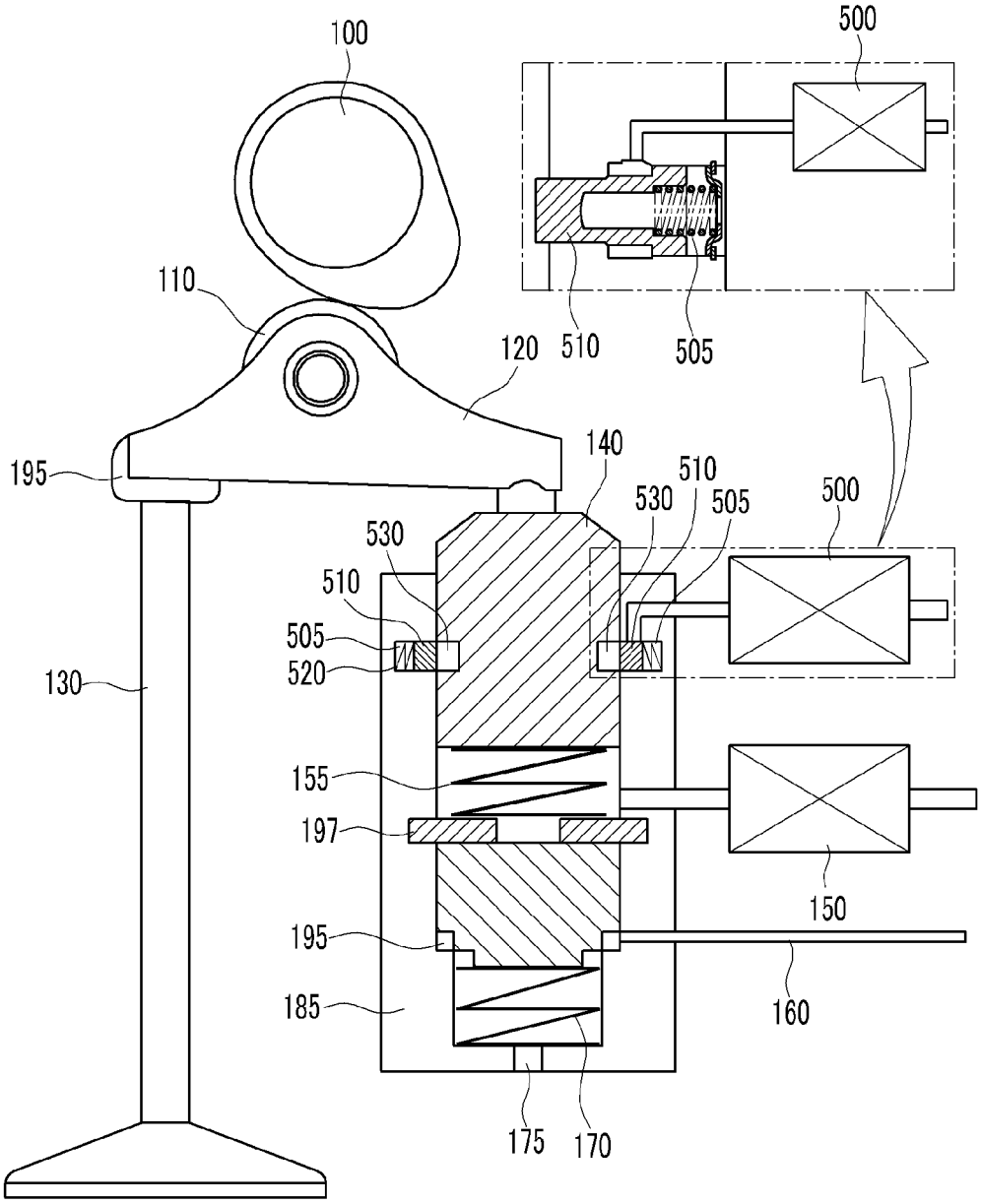
FIG. 5 is a cross-sectional side view of an engine that is provided with a variable valve device according to another exemplary embodiment of the present invention.

FIG. 5 is a cross-sectional side view of an engine that is provided with a variable valve device according to another exemplary embodiment of the present invention. As compared with the features of FIGS. 1, 2, 3, and 4, distinct parts will be described referring to FIG. 5, and a detailed description regarding similar parts will be omitted.

Referring to FIG. 5, a latching groove is formed at an exterior circumference of the master piston 140 facing an interior circumference of the housing, a latching chamber 505 is formed at an interior circumference of the housing 185 corresponding to the latching groove 530, and a latching pin 510 is inserted into the latching chamber 505.

Further, a latching spring 520 is disposed inside the latching chamber 505 and the latching spring 520 has a structure pushing the latching pin 510 outwardly. The latching chamber 505 is connected to a oil supply passage that is opened/closed by a latching oil control valve 500 to receive the hydraulic pressure depending on the ON/OFF of the latching oil control valve 500.

If the latching chamber 505 does not receive the hydraulic pressure through the latching oil control valve 500, a front end of the latching pin 510 is inserted into the latching groove 530 by the latching spring 520 such that the master piston 140 and the housing 185 are fixed from each other. Accordingly, the valve 130 is normally lifted thereby.

However, if the latching chamber 505 receives the hydraulic pressure through the latching oil control valve 500, the latching pin 510 leaves the latching groove 530 by the latching spring 520 such that the master piston 140 slides with the housing 185. Accordingly, the valve 130 does not move or low lifted through a lost motion.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine that is provided with a variable valve device, comprising:

an hydraulic pressure lash adjuster pivotally supporting one side of a swing arm;

a valve supporting the other side of the swing arm;

an operating portion pushing a portion of the swing arm downwards so as to pivotally move the valve based on the hydraulic pressure lash adjuster; and a brake chamber oil supply line that is connected to a brake chamber for supplying the brake chamber with oil;

wherein the hydraulic pressure lash adjuster comprises:

a housing in which an insertion hole is formed therein;

a slave piston that is slidably inserted into the insertion hole;

a master piston of which an end thereof is placed into the insertion hole with a predetermined gap from the slave piston, wherein the other end of the master piston protrudes out of the housing and is engaged with the one side of the swing arm; and an oil control valve that opens or closes a passage communicating with a master chamber that is formed between the master piston and the slave piston in the housing, wherein the brake chamber is formed by a slave step of which an exterior diameter of the slave piston becomes narrower, a housing inside surface, a housing step of which an interior diameter of the housing becomes narrower, and a slave outside surface of the slave piston at an opposite side of the master piston, wherein an orifice is formed in the slave piston so as to continuously connect the brake chamber with a slave chamber, and wherein the slave outside surface of the slave piston and an inside end surface of the insertion hole are slidably in contact and the housing inside surface and external circumference of the slave piston are slidably in contact.

2. The engine of claim 1, further comprising:

a stopper that is disposed inside the insertion hole such that the slave piston cannot move towards the master piston;

a master spring that elastically supports the master piston outwards in the master chamber; and a slave spring that elastically supports the slave piston towards the stopper in the insertion hole.

3. The engine of claim 2, wherein the slave chamber is formed between an end surface of the slave piston and the inside end surface of the insertion hole of the housing, and a drain hole through which oil in the slave chamber is exhausted is formed thereto.

4. The engine of claim 2, further comprising:

a latching pin slidably disposed in a latching chamber formed in the master piston to selectively fix the master piston to the housing such that the master piston cannot move in the housing; and a hydraulic pressure supply portion that supplies one side of the latching pin with hydraulic pressure in the latching chamber so as to move the latching pin.

5. The engine of claim 4, wherein an end of the latching pin is slidably inserted into a side of the master piston and the other end thereof is selectively inserted into a side of the housing such that the master piston is selectively fixed in the housing.

6. The engine of claim 5, further comprising a return spring that elastically pushes the latching pin such that the latching pin is biased to the housing.

7. The engine of claim 5, wherein latching pins are respectively disposed at both sides based on a center portion of the master piston in the latching chamber, each end portion thereof is selectively inserted through the master piston into the housing, and the hydraulic pressure supply portion supplies the latching pins with hydraulic pressure through the housing and the master piston.

8. The engine of claim 4, wherein a latching chamber is formed at an interior circumference of the housing and the latching pin is slidably inserted into the latching chamber, a latching groove is formed at an exterior circumference of the master piston corresponding to the latching chamber to selectively receive the latching pin therein, and the hydraulic pressure supply portion selectively supplies hydraulic pressure to the latching chamber to latch the latching pin with the latching groove such that the housing and the master piston are fixed or slides from each other.

9. The engine of claim 8, wherein a latching spring is disposed in the latching chamber to elastically support the latching pin.

* * * * *